US007662219B2

(12) United States Patent
Maekawa et al.

(10) Patent No.: US 7,662,219 B2
(45) Date of Patent: Feb. 16, 2010

(54) WET TYPE ELECTROSTATIC PRECIPITATOR

(75) Inventors: Sachio Maekawa, Tokyo (JP); Mitsuaki Yanagida, Tokyo (JP); Shinichi Kawabata, Tokyo (JP); Keigo Orita, Tokyo (JP); Yoshihiko Mochizuki, Tokyo (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 0 days.

(21) Appl. No.: 12/073,011

(22) Filed: Feb. 28, 2008

(65) Prior Publication Data

US 2008/0216658 A1 Sep. 11, 2008

(30) Foreign Application Priority Data

Mar. 5, 2007 (JP) ..... 2007-054705

(51) Int. Cl.
*B03C 3/78* (2006.01)

(52) U.S. Cl. ..... 96/25; 95/75; 96/44; 96/45; 96/50; 96/53; 96/95

(58) Field of Classification Search ..... 95/59, 95/64, 65, 71, 75; 96/44, 45, 50, 52, 53, 96/25, 26, 95
See application file for complete search history.

(56) References Cited

U.S. PATENT DOCUMENTS 1,250,088 A * 12/1917 Burns ..... 95/75
2,874,802 A * 2/1959 Gustafsson et al. ..... 95/71
3,444,668 A * 5/1969 Masuda ..... 96/47
3,765,154 A * 10/1973 Hardt et al. ..... 96/88
3,785,118 A * 1/1974 Robertson ..... 95/71
3,958,960 A * 5/1976 Bakke ..... 96/47
3,960,505 A * 6/1976 Marks ..... 422/168
4,553,987 A * 11/1985 Artama et al. ..... 96/44
4,885,139 A * 12/1989 Sparks et al. ..... 422/169
5,254,155 A * 10/1993 Mensi ..... 96/44
5,424,044 A * 6/1995 Kalka ..... 422/171
5,427,608 A * 6/1995 Auer et al. ..... 95/65
5,601,791 A * 2/1997 Plaks et al. ..... 422/169
5,624,476 A * 4/1997 Eyraud ..... 95/65
6,302,945 B1 * 10/2001 Altman et al. ..... 96/44
6,488,740 B1 * 12/2002 Patel et al. ..... 95/71
2003/0000388 A1 * 1/2003 Tomimatsu et al. ..... 96/44
2003/0217642 A1 * 11/2003 Pasic et al. ..... 96/44

FOREIGN PATENT DOCUMENTS

JP A 05-023614 2/1993
JP A 2002-045643 2/2002
JP A 2002-119889 4/2002

* cited by examiner

*Primary Examiner*—Richard L Chiesa
(74) *Attorney, Agent, or Firm*—Oliff & Berridge, PLC

(57) ABSTRACT

An electrostatic precipitator that can prevent the corrosion of a discharge electrode even if a gas to be treated containing a corrosive mist is treated. In an electrostatic precipitator having a discharge electrode arranged along a flow path of the gas to be treated, a spray nozzle that can spray a water to the upstream side of the discharge electrode is mounted. A wet film is formed on the surface of the discharge electrode with the water sprayed from the spray nozzle. The sprayed water is desirably a water vapor or a water droplet having a particle diameter of less than 10 μm.

7 Claims, 4 Drawing Sheets

WET TYPE ELECTROSTATIC PRECIPITATOR

BACKGROUND (a) Field of the Invention

The present invention relates to a wet type electrostatic precipitator, and more particularly to a wet type electrostatic precipitator having a discharge electrode arranged along a flow path of a gas to be treated.

(b) Description of the Related Arts

Exhaust gas exhausted from a furnace that employs heavy oil or coal as a fuel contains sulfur oxides generated from sulfur contents in the fuel. Therefore, from such exhaust gas exhausted from a boiler for a thermal power plant, dust is removed by a dry-type electrostatic precipitator, then, sulfur oxides are removed by a wet type desulfurizer, and finally, the exhaust gas is guided to a wet type electrostatic precipitator where a mist or the like is removed and then the resultant is emitted to the atmosphere, as disclosed in the Japanese Unexamined Patent Application No. 2002-45643.

Although the sulfur oxide contained in this type of the exhaust gas is mainly sulfur dioxide, sulfur trioxide of several ppm level is present. The sulfur trioxide reacts readily with water to become sulfuric acid, which is condensed to form a sulfuric acid mist when a gas temperature becomes the dew point of sulfuric acid or lower. Since the sulfuric acid mist has strong corrosivity, the temperature of the exhaust gas is kept to the temperature higher than the dew point of the sulfuric acid (e.g., about 170° C.), at a stage before the wet type desulfurizer. However, when the exhaust gas is guided to the wet type desulfurizer to rapidly cool the same to about 55° C., which is the dew point of water, a micromist of sulfuric acid is formed. The micromist is difficult to be removed by the wet type desulfurizer, so it is removed at the wet type electrostatic precipitator at a later stage.

In the wet type electrostatic precipitator, a mist such as the micromist of sulfuric acid in the exhaust gas transmitted from the wet type desulfurizer and remaining dust is collected to a dust-collecting electrode based on a principle of electrostatic precipitation. The collected mist itself forms a wet film on the surface of the dust-collecting electrode and naturally flows down. When the amount of the mist is small and the natural flow-down is difficult to occur, washwater is flown all times or intermittently from above the dust-collecting electrode so as to flow down the mist and dust collected on the dust-collecting electrode.

However, when the gas to be treated containing a corrosive mist, such as sulfuric acid mist treated in the wet type electrostatic precipitator, a mist is collected on the dust-collecting electrode, whereby the discharge electrode is likely to be dried. Therefore, when the corrosive mist in the gas to be treated is adhered onto the discharge electrode, the corrosive mist is enriched due to the dryness. Accordingly, the discharge electrode is corroded, thereby entailing a problem of decreasing the usable life of the discharge electrode. In order to improve the problem described above, it is considered that washwater is sprayed from above the discharge electrode to flow down the corrosive mist adhered onto the discharge electrode. However, in such way, the sprayed water droplets are flown by a gas flow, and thus the water droplets cannot reach the lower part of the discharge electrode. Therefore, it is difficult to flow down the corrosive mist adhered onto the discharge electrode entirely. Further, if the particle diameter of the sprayed water droplet is increased so as to prevent the water droplet from being flown by the gas flow, most of the water droplets are collected to the dust-collecting electrode.

Therefore, sufficient washing effect cannot be attained, and conversely, there arises a problem that the water droplets induce sparks.

SUMMARY

The object of the present invention is to remedy the aforesaid problems of the conventional technique, and to provide a wet type electrostatic precipitator that can supply water all over a discharge electrode, and can prevent corrosion of the discharge electrode, even if a gas to be treated contains a corrosive mist is treated.

In order to achieve the foregoing object, a wet type electrostatic precipitator according to the present invention is a wet type electrostatic precipitator having a discharge electrode arranged along a flow path of a gas to be treated, including spraying means that is arranged at the upstream side of the discharge electrode and is capable of spraying a water mist or water vapor, wherein the water mist or water vapor sprayed from the spraying means forms a wet film on the surface of the discharge electrode.

In the wet type electrostatic precipitator according to the present invention, the spraying means is a spray nozzle that sprays a water vapor or mist having a particle diameter of less than 10 mm. It is desirable that control means capable of intermittently controlling the flow rate of the sprayed water mist or water vapor is mounted to the spraying means. For the wet type electrostatic precipitator according to the present invention, a roughening process for roughening the surface of the discharge electrode is performed.

The water mist or water vapor sprayed from the spraying means flows along the flow path of the gas to be treated from the upstream side to the downstream side of the discharge electrode, and successively adhere onto the discharge electrode during this process and thus a wet film is formed on the surface of the discharge electrode. The wet film serves as a protective film against a corrosive mist. Specifically, even if the corrosive mist is adhered onto the discharge electrode, the corrosive mist is sufficiently diluted by the wet film. Therefore, the corrosive force is reduced to thereby remarkably prevent the corrosion of the discharge electrode. When the thickness of the wet film increases, it naturally flows down by its own weight. Accordingly, the wet film is not grown to a certain thickness or more. The wet film keeps on being renewed by a condensed water or mist that is newly adhered, therefore the function of the protective film is not deteriorated.

If the spraying means sprays a water vapor or mist having a particle diameter of less than 100 mm, the wet film can be easily formed all over the discharge electrode in the widthwise direction and depth direction. Providing a mounted control means, which can control the flow rate of the water mist or water vapor sprayed from the spraying means, makes it possible to automatically execute the intermittent washing operation on the discharge electrode. Therefore, the corrosion of the discharge electrode can further be prevented. Since the roughening process for roughening the surface of the discharge electrode is performed, the wet film is satisfactorily formed and maintained on the discharge electrode, whereby the corrosion preventing effect is enhanced.

DETAILED DESCRIPTION OF EMBODIMENTS

Figure 1:
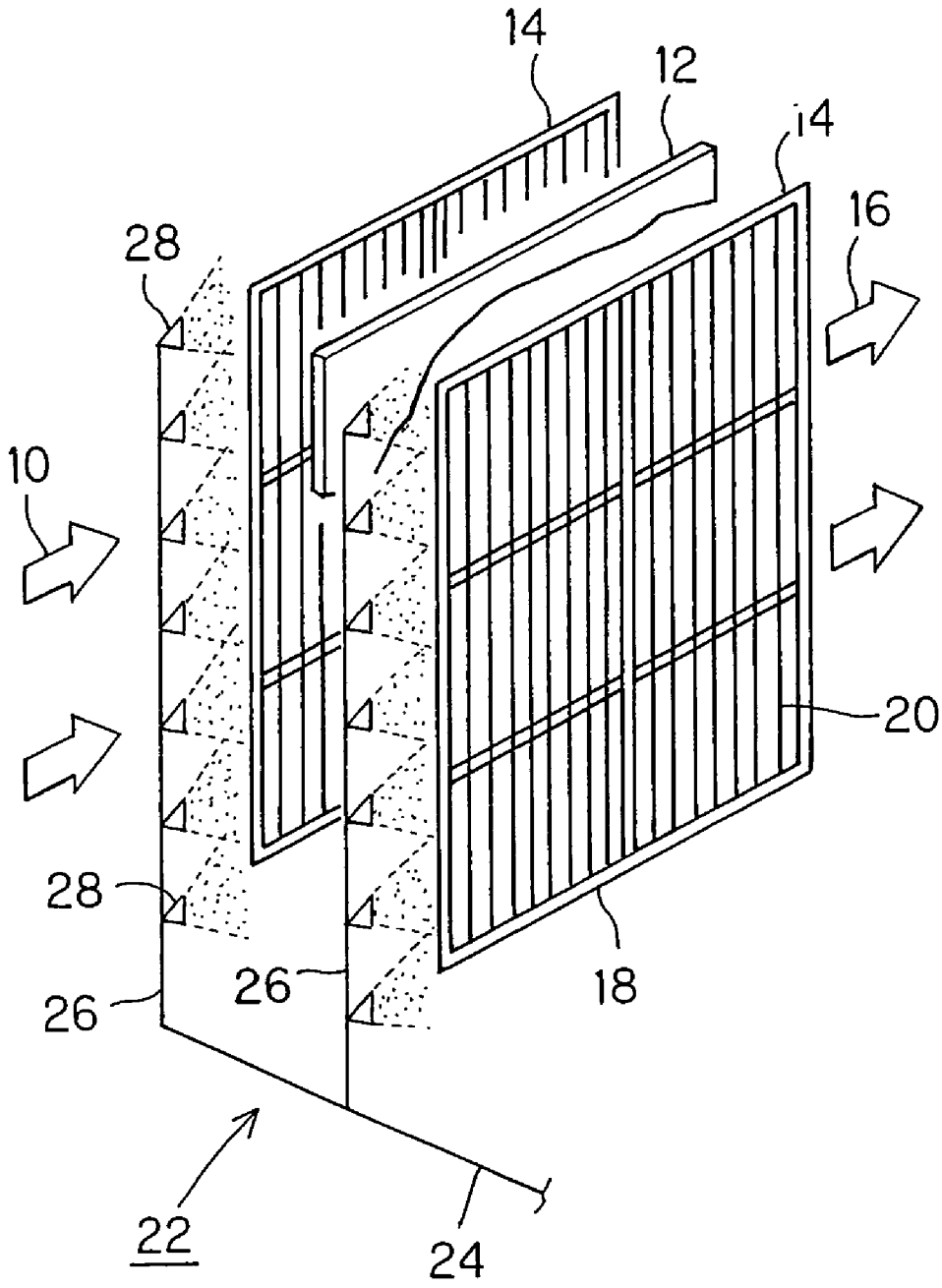
FIG. 1 is a perspective view showing an essential part of a wet type electrostatic precipitator according to a first embodiment of the present invention.
Figure 2:
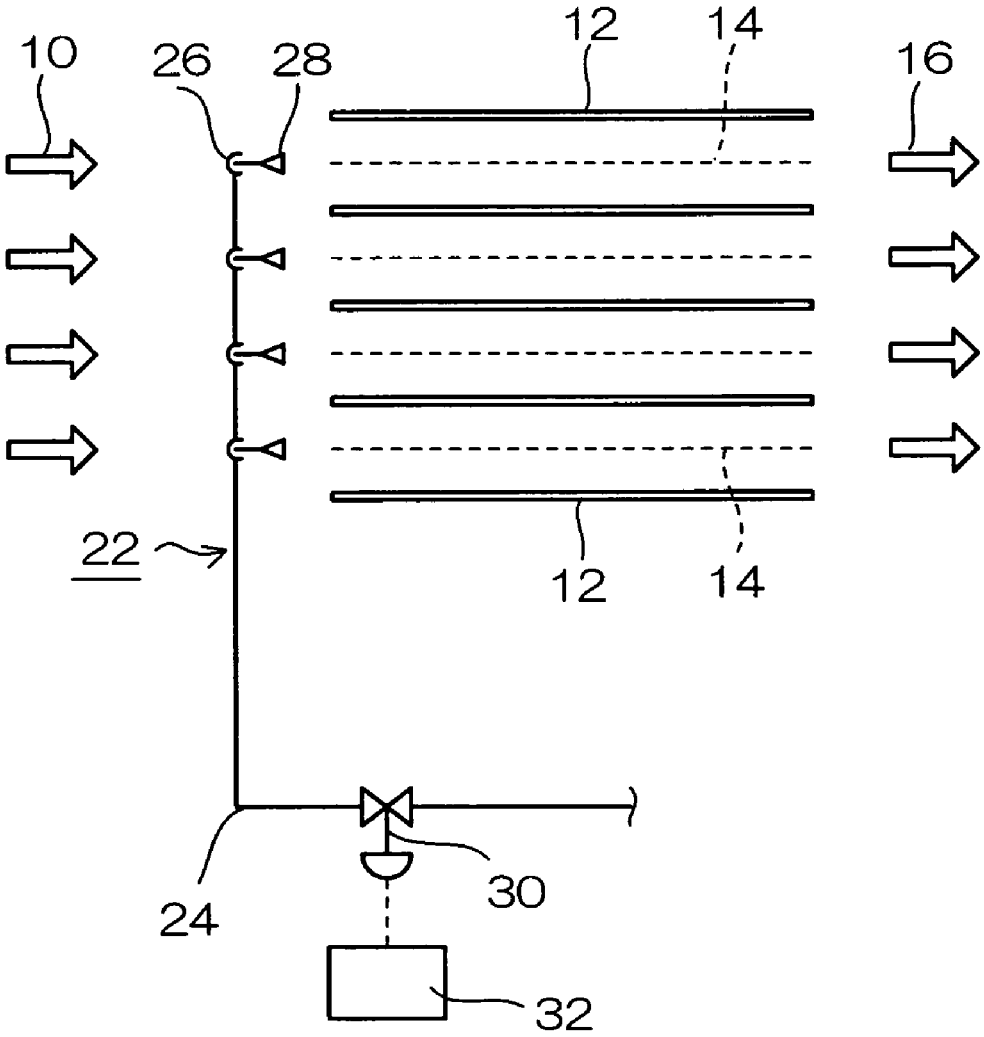
FIG. 2 is a plan view also showing the essential part of the wet type electrostatic precipitator according to the first embodiment of the present invention.

FIG. 1 is a perspective view showing an essential part of a wet type electrostatic precipitator according to a first embodiment of the present invention and FIG. 2 is a plan view also showing the essential part of the wet type electrostatic precipitator according to the first embodiment of the present invention.

As shown in FIG. 2, in a casing of a wet type electrostatic precipitator, dust-collecting electrodes 12 and discharge electrodes 14 are alternately arranged with a predetermined space along a lateral flow path of a gas to be treated 10 containing a corrosive mist such as a sulfuric acid mist. A mist and remaining dust in the gas to be treated 10 are collected to the dust-collecting electrodes 12 based on a principle of electrostatic precipitation. The gas to be treated 16 after the mist and dust are removed by the electrostatic precipitation is exhausted to the outside of the casing. The mist collected to the dust-collecting electrodes 12 itself forms a wet film on the surface of the dust-collecting electrodes 12, and then, naturally flows down. Alternatively, when the amount of the mist is so small that the natural flow-down is difficult to occur, washwater is flown from above the duct-collecting electrodes 12 constantly or intermittently to flow down the mist or dusts collected to the dust-collecting electrodes 12.

As shown in FIG. 1, the discharge electrode 14 has a structure in which a great number of discharge wires 20 are stretched on a discharge frame 18 assembled in a lattice. The discharge electrode 14 is connected to an unillustrated high-voltage power supply from which high voltage is applied thereto. A spray device 22 is disposed on front side of the discharge electrode 14 and on the upstream side (on the side into which the gas to be treated 10 is flown) of the discharge electrode 14. The spray device 22 has a header pipe 24 connected to a water vapor source not shown, plural spray pipes 26 rising from the header pipe 24 so as to be orthogonal to the flow path of the gas to be treated 10 for every discharge electrode 14, and plural spray nozzles 28 mounted to the spray pipes 26 at a predetermined space. The spray nozzles 28 are mounted in such a manner that the spraying direction toward the discharge electrodes 14 along the arrangement plane of the discharge electrodes 14. The water vapor supplied from the water vapor source is sprayed from the spray nozzles 28 through the header pipe 24 and the spray pipes 26. The type of the spray nozzle 28, the mounting space and spraying amount are designed such that the sprayed water vapors spread all over the discharge electrodes 14 in the widthwise direction and depth direction.

As a result, the water vapor sprayed from the spray nozzles 28 flow along the flow path of the gas to be treated 10 from the upstream side toward the downstream side of the discharge electrodes 14. When the water vapor is saturated vapor of about 100° C., and the temperature of the gas to be treated 10 is about 50 to 60° C., the sprayed water vapors are cooled by the gas to be treated 10, and some of them are condensed to form fine water droplets. Therefore, the condensed fine water droplets successively adhere onto the discharge frame 18 or discharge wires 20 composing the discharge electrode 14 from the upstream side to the downstream side of the discharge electrode 14, thereby forming a wet film on the entire surface of the discharge electrode 14. This wet film serves as a protective film against the corrosive mist. Specifically, even if the corrosive mist adheres onto the discharge electrode 14, the corrosive mist is sufficiently diluted by the wet film, with the result that the corrosive force is reduced. Accordingly, the corrosion of the discharge electrode 14 can remarkably be prevented. When the thickness of the wet film increases, it naturally flows down by its own weight. Accordingly, the wet film is not grown to a certain thickness or more. The wet film keeps on being renewed by a condensed water or mist that is newly adhered, therefore the function as the protective film is not deteriorated.

It is desirable that the spray nozzle 28 sprays the water vapor with the flow rate substantially equal to the flow rate of the gas in order to cause the sprayed water vapor to be easily carried on the gas flow of the gas to be treated. The reason of this is as follows. In the electrostatic precipitator, the exhaust gas is rectified and passes in order to disperse the airflow uniformly. Therefore, preventing the disturbance in the airflow caused by the sprayed water vapor as much as possible is effective for maintaining the dust-collection function. As shown in FIG. 2, a flow control valve 30 is mounted to the header pipe 24, wherein a controller 32 may intermittently control the flow control valve 30. Specifically, a timer function is provided to the controller 32, and upon the normal operation, the controller 32 controls the flow rate of the water vapor sprayed from the spray nozzle 28 to be equal to the flow rate of the gas in order to mainly prevent the discharge electrodes 14 from drying. Once in several hours, the controller 32 executes an operation, for several minutes, in which the flow rate of the water vapor sprayed from the spray nozzle 28 is controlled to be two times to ten times greater than the gas flow rate, through the control of the opening of the flow control valve 30 in order to mainly wash the discharge electrodes 14. By employing the control means described above, the intermittent washing operation to the discharge electrodes 14 can automatically be performed, resulting in that the corrosion of the discharge electrodes 14 can be more prevented.

Figure 4:
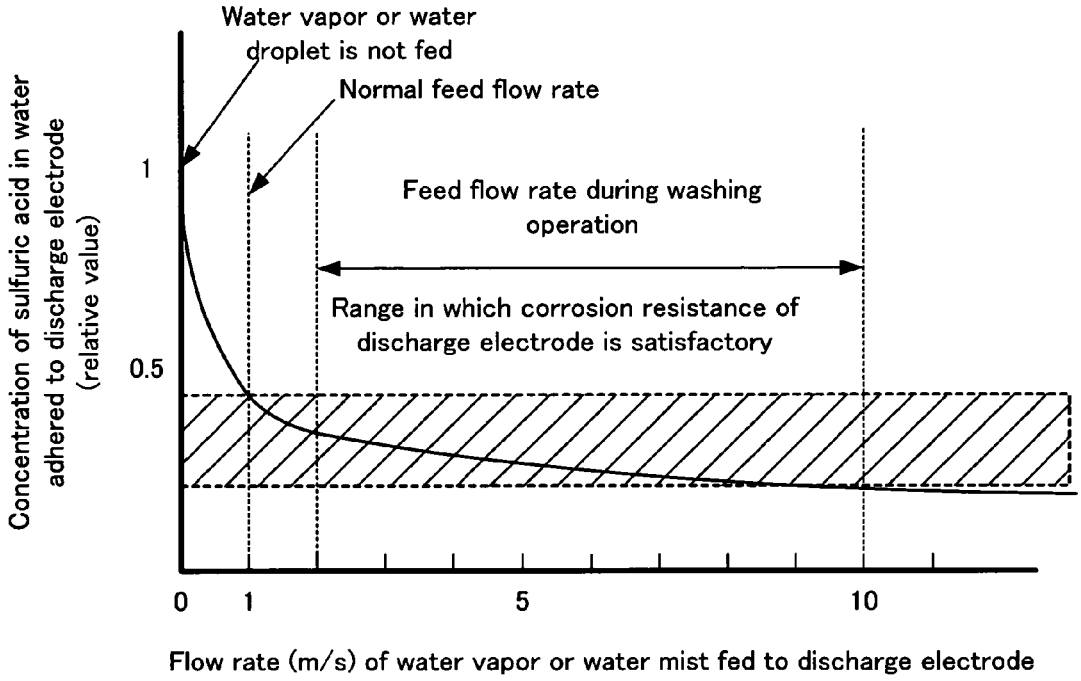
FIG. 4 is a view showing the relationship between the flow rate of a water vapor or water mist supplied to the discharge electrode and concentration (relative value) of sulfuric acid in the water adhered to the discharge electrode.

FIG. 4 shows the condition in which the concentration of the sulfuric acid component in the adhered water changes relative to the feed flow rate, supposing that the case in which the water vapor or water mist not fed is defined as a relative value of 1. As can be understood from FIG. 4, the concentration satisfactorily reduces with the flow rate up to 1 m/s that is substantially equal to the gas flow rate. However, as the flow rate exceeds the gas flow rate, the degree of diffusion in the gas increases, and then efficient utilization becomes difficult. When the reduction in the concentration exceeds 100 m/s, the concentration becomes generally constant at about 0.3. It is considered that the corrosion resistance of the discharge electrode is satisfactory within the concentration of 0.2 to 0.4 (relative value) (hatched area). Therefore, the flow rate of the water vapor or water mist fed to the discharge electrode is desirably 1 to 10 m/s. The water vapor or water mist is fed with the flow rate two times to ten times greater than the gas flow rate during the washing operation, whereby the concentration of sulfuric acid can rapidly be reduced at one time.

A roughening process for roughening the surface of the discharge electrode 14 is desirably performed. Examples of usable roughening process include filing process, blast process, dimple process, channeling process, etc. When such a roughening process is performed, the formation and maintenance of the wet film on the discharge electrode become satisfactory, whereby the corrosion preventing operation is enhanced. Since some of the discharge wires at the downstream side of the gas, among the great number of discharge wires 20 that are the main components of the discharge electrode 14, are readily dried, the roughening process is desirably performed on the surface of discharge wires 20, particularly in such part.

As described above, the wet type electrostatic precipitator of the present embodiment can form a wet film all over the discharge electrode without flowing washwater from above the discharge electrode, even if a gas to be treated containing a corrosive mist is treated, whereby the corrosion of the discharge electrode can be prevented.

Figure 3:
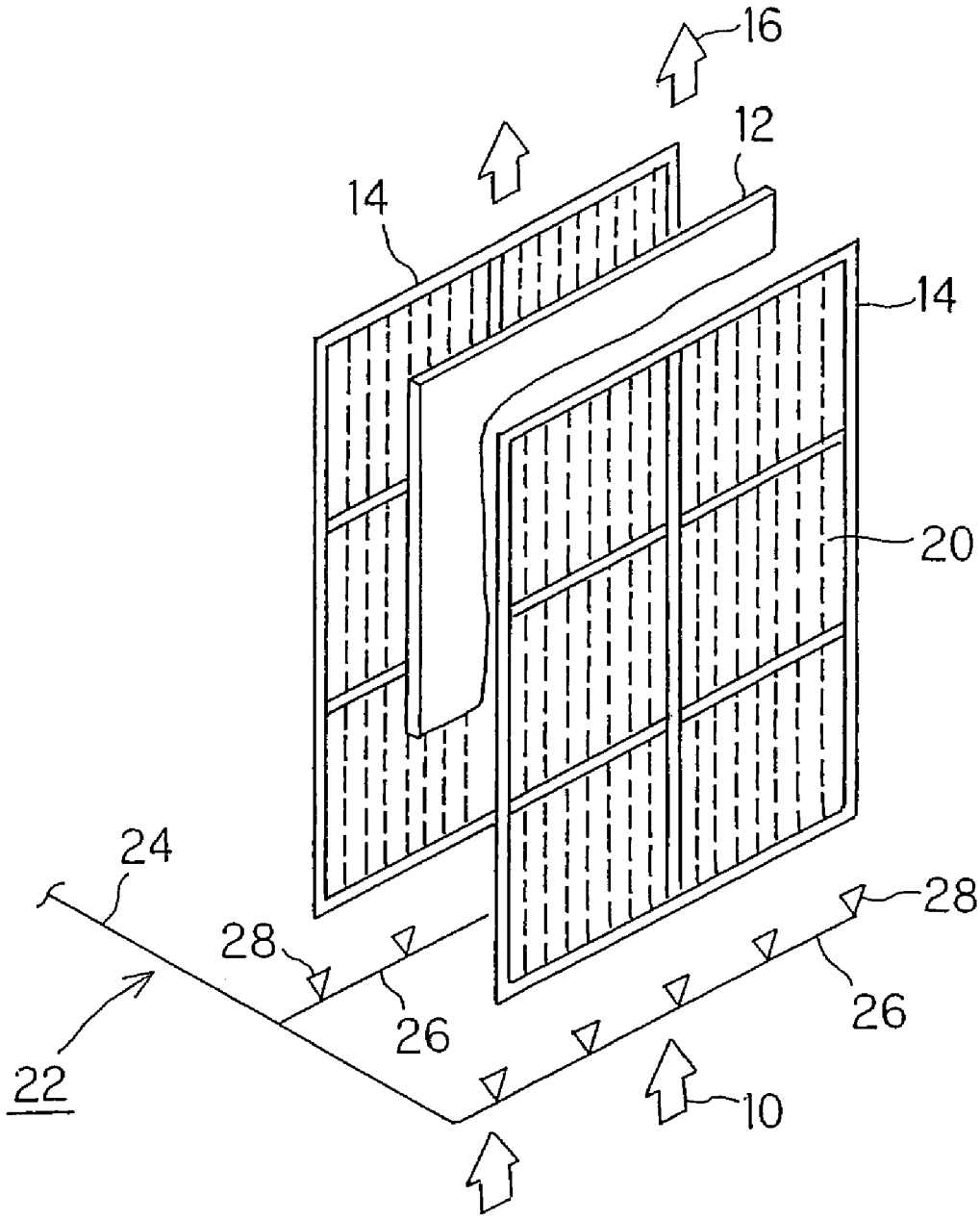
FIG. 3 is a perspective view showing the essential part of the wet type electrostatic precipitator according to a second embodiment of the present invention.

FIG. 3 is a perspective view showing an essential part of a wet type electrostatic precipitator according to a second embodiment of the present invention. In FIG. 3, the components identified by the same numerals as in FIG. 1 are the components having the function similar to that in the first embodiment, so that the explanation thereof is not repeated here. In the present embodiment, the gas to be treated 10 containing a corrosive mist such as a sulfuric acid mist, flows in the vertical direction from the lower side to the upper side. The dust-collecting electrodes 12 and the discharge electrodes 14 are alternately arranged with a predetermined space along the vertical flow path of the gas to be treated 10. In this case too, the spray device 22 is mounted at the upstream side of the discharge electrodes 14, whereby the effect same as those in the first embodiment can be attained.

In the above-mentioned each embodiment, the case in which saturated steam is sprayed from the spray nozzle 28 is described. However, the water sprayed from the spraying means according to the present invention is not limited to the saturated steam. Unsaturated steam, superheated steam, or moist air sufficiently containing water vapor may be employed, and in this case, the similar effect can be attained. When the temperature of the gas to be treated 10 is so high exceeding 100° C., the formation of water droplets due to the condensation of water vapor cannot be expected. Therefore, in this case, water droplets are desirably sprayed from the spraying means.

It is to be noted that a water droplet having a particle diameter of 10 mm or more readily falls down by its own weight, or is readily charged and attracted by the dust-collecting electrodes. Thus, it is not effective for forming a wet film on the discharge electrodes. Accordingly, it is desirable that the water mist having a particle diameter of less than 10 mm, more preferably a water mist having a particle diameter adjusted to approximately 1 mm is sprayed, in the case of a water mist. When the particle diameter is less than 10 mm, the moving speed by electrostatic force is overwhelmingly predominant to the free fall speed by gravity, and this is more predominant with a particle of a smaller diameter.

The spraying means according to the present invention is not limited to the spray nozzle 28 described in the aforesaid each embodiment. For example, the structure in which water is sprayed from a continuous thin slit may be employed. The spraying means is not limited to a fixed type. A moving type or a movable type that changes the spraying direction may be employed.

What is claimed is:

1. An electrostatic precipitator having a discharge electrode arranged along a flow path of a gas to be treated, comprising:

spraying means comprising a flow control valve and a controller with a timer that is arranged at an upstream side of the discharge electrode and sprays a water mist or water vapor, wherein the water mist or water vapor sprayed from the spraying means forms a wet film on a surface of the discharge electrode, wherein the spraying means sprays the water mist or water vapor with a flow rate substantially equal to a flow rate of the gas to be treated.

2. The electrostatic precipitator according to claim 1, wherein the spraying means has a nozzle that forms a spraying plane along an arrangement plane of the discharge electrode.

3. The electrostatic precipitator according to claim 1, wherein the spraying means has a nozzle that forms a spraying plane along an arrangement plane of the discharge electrode, and the nozzle is a spray nozzle that sprays the water mist or water vapor having a particle diameter of less than 10 μm.

4. The electrostatic precipitator according to claim 1, wherein the spraying means is provided with a control means that intermittently controls the flow rate of the sprayed water mist or water vapor.

5. The electrostatic precipitator according to claim 1, wherein a roughening process for roughening the surface of the discharge electrode is performed.

6. An electrostatic precipitator having a discharge electrode arranged along a flow path of a gas to be treated, comprising:

spraying means comprising a flow control valve and a controller with a timer that sprays a water vapor to an upstream side of the discharge electrode, wherein the spraying means is arranged along a same plane as an arrangement plane of the discharge electrode and toward the discharge electrode, and sprays the water vapor with a flow rate substantially equal to a flow rate of the gas to be treated, and wherein a wet film is formed on a surface of the discharge electrode with the water vapor sprayed from the spraying means.

7. An electrostatic precipitator having a discharge electrode arranged along a flow path of a gas to be treated, comprising:

spraying means that is arranged at an upstream side of the discharge electrode and sprays a water mist or water vapor, wherein:

the water mist or water vapor sprayed from the spraying means forms a wet film on a surface of the discharge electrode;

the spraying means has a nozzle that forms a spraying plane along an arrangement plane of the discharge electrode, and the nozzle is a spray nozzle that sprays the water mist or water vapor having a particle diameter of less than 10 μm; and the spraying means sprays the water mist or water vapor with a flow rate substantially equal to a flow rate of the gas to be treated.

* * * * *